US009617817B2

(12) United States Patent
Varney

(10) Patent No.: US 9,617,817 B2
(45) **Date of Patent: *Apr. 11, 2017**

(54) ANTI-ALTERATION WELLHEAD VAULT

(71) Applicant: Paul Varney, Petersham, MA (US)

(72) Inventor: Paul Varney, Petersham, MA (US)

( * ) Notice: Subject to any disclaimer, the term of this patent is extended or adjusted under 35 U.S.C. 154(b) by 635 days.

This patent is subject to a terminal disclaimer.

(21) Appl. No.: 13/789,428

(22) Filed: Mar. 7, 2013

(65) Prior Publication Data

US 2013/0233569 A1 Sep. 12, 2013

Related U.S. Application Data

(60) Provisional application No. 61/608,044, filed on Mar. 7, 2012.

(51) Int. Cl.

| | |
|---|---|
| ***E21B 33/03*** | (2006.01) |
| ***E21B 33/00*** | (2006.01) |
| ***E21B 33/035*** | (2006.01) |
| ***E21B 41/00*** | (2006.01) |

(52) U.S. Cl.
CPC ..... *E21B 33/03* (2013.01); *E21B 33/00* (2013.01); *E21B 33/035* (2013.01); *E21B 41/0021* (2013.01)

(58) Field of Classification Search
CPC ..... E21B 33/03; E21B 41/0021; E21B 33/00; E21B 33/035; E21B 43/01
See application file for complete search history.

(56) References Cited

U.S. PATENT DOCUMENTS

2011/0274493 A1* 11/2011 Cutts ..... 405/60

* cited by examiner

*Primary Examiner* — Yong-Suk (Philip) Ro
(74) *Attorney, Agent, or Firm* — Gerry A. Blodgett; David J. Blodgett; Blodgett & Blodgett, P.C.

(57) ABSTRACT

A wellhead vault for preventing alteration of the wellhead of a water supply. The vault is a heavy bell-shaped structure, formed of concrete, and placed over and around the wellhead. The vaults too heavy to be removed by human lifting. Lifting elements are provided to allow the vault to be installed and removed by heavy construction equipment.

6 Claims, 6 Drawing Sheets

ANTI-ALTERATION WELLHEAD VAULT

CROSS-REFERENCE TO RELATED APPLICATIONS

This application claims the benefit under 35 U.S.C. §119(e) of U.S. Provisional Application No. 61/608,044 filed Mar. 7, 2012, which is hereby incorporated by reference.

STATEMENT REGARDING FEDERALLY SPONSORED RESEARCH OR DEVELOPMENT

This invention has been created without the sponsorship or funding of any federally sponsored research or development program.

FIELD OF THE INVENTION

This invention involves a system for protecting wellheads that are part of water supplies.

BACKGROUND OF THE INVENTION 40 years ago, there seemed to be no terrorist threat, but in today's world it seems we have people and groups of people that will stop at nothing to hurt, maim and kill others, even children. This invention involves a wellhead that is protected by an anti-alteration well vault. The vault enhances the security of our precious water supply and protects the safety of water supply consumers. This protected wellhead will go a long way toward protecting municipal and private well water supplies and could be used also to protect oil or gas wells, whether active or abandoned, from alteration, including not only tampering, vandalism, and terrorism, but also intentional and unintentional damage and intrusion by both human and non-human perpetrators.

It is common and usually necessary, in the provision of well water to a small community water system, to have a portion of the water delivery system, including upper end of the well and associated connections, above ground. This portion is known as a wellhead. The wellhead provides an air source in order for the pump to function properly and the final connection from the water supply to a private dwelling is attached at the wellhead. The wellhead is frequently located in unobtrusive, sparsely populated areas and therefore extremely vulnerable to malicious vandalism and terrorism, and various kinds of accidents.

Although various locking mechanisms and security chain systems have been used to protect wellheads from malicious tampering, easily available portable power tools can defeat most of these protections easily, quickly, and inconspicuously. This invention effectively decreases the possibility of a terrorist or local malicious vandal covertly tampering with the water supply through the wellhead.

These and other difficulties experienced with the prior art devices have been obviated in a novel manner by the present invention.

It is, therefore, an outstanding object of some embodiments of the present invention to provide a system for protecting the wellhead of a water supply from undesired alteration, both intentional and accidental, and including vandalism and terrorism.

It is another outstanding object of some embodiments of the present invention to provide a system for protecting the wellhead of a water supply from undesired alteration, that is cost-effective.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

A wellhead vault for preventing alteration of the wellhead of a water supply. The vault is a heavy bell-shaped structure, formed of concrete, and placed over and around the wellhead. The vaults too heavy to be removed by human lifting. Lifting elements are provided to allow the vault to be installed and removed by heavy construction equipment. The invention may be perceived as the vault itself, the vault and wellhead combination, and the method of using the vault on the wellhead.

This invention is a wellhead enclosure formed of a relatively immovable, indestructible well vault which prevents malicious or accidental access to the attached supply system.

One embodiment of the invention includes a wellhead enclosure formed of a heavy bell shaped pre-formed concrete vault that has been lifted in place using heavy lifting equipment. The vault is constructed from a material that would require a noisy and conspicuous effort to penetrate. Furthermore, the well vault is of such a weight that it can only be moved using heavy-duty construction equipment, use of which would also necessarily be noisy and conspicuous.

One benefit of this invention is that, along with anti-tampering protection, it also protects the vulnerable exposed wellhead from accidental damage from a vehicle or a piece of heavy equipment colliding with the wellhead itself. The mass of the well vault will repel the vehicle.

Also, the top portion the well vault could be made dome-shaped in order to improve the run-off of rain and snow causing far less weather related degradation of the enclosure. Or it could be made flat to form a shelf for placing objects. Or it could be concave to form a bird bath. The exterior of the well vault could be decorated before or after casting to make it look attractive when that is appropriate.

BRIEF DESCRIPTION OF THE DRAWINGS

The character of the invention, however, may best be understood by reference to one of its structural forms, as illustrated by the accompanying drawings, in which:

FIG. 11 shows the flotation ball in its lower position in which air is allowed to pass in and out of the vent.

FIG. 12 shows the flotation ball in its upper position in which water is not allowed to pass through the vent, and into the wellhead chamber.

DETAILED DESCRIPTION OF THE INVENTION

Figure 1:
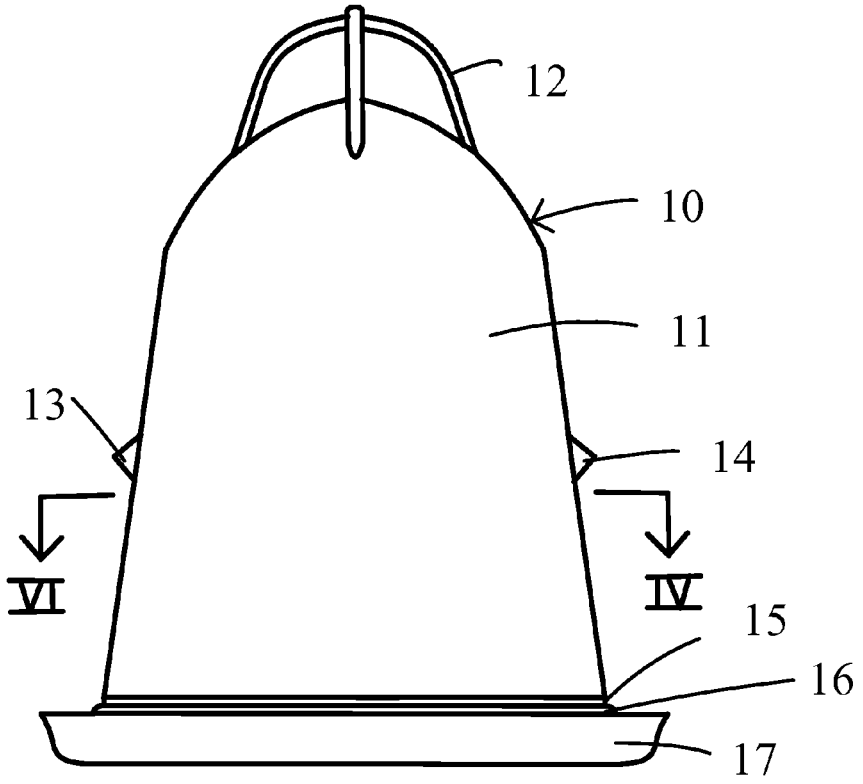
FIG. 1 is a front elevation view of an embodiment of a wellhead vault of the present invention.

One embodiment of the anti-alteration wellhead vault of the present invention is an inverted bell-shaped concrete structure that encloses the upper, exposed, end of a well, and the vault's heavy concrete construction is designed to prevent the enclosure from being moved by individuals without the assistance of heavy equipment. Although concrete is the preferred material from which this vault is manufactured, any relatively dense material such as metal, or composite polymeric materials, such as sand or gravel mixtures in a polymer matrix, could also be used. One embodiment of the well cover is constructed using cast concrete including cast-in re-bar (reinforcement bar) lifting loops, and weighs approximately 1200 pounds. Its primary purpose is to protect the drinking water well from tampering as well as keeping rodents and other creatures from accessing the metal well cap which is usually vented. The well cover is constructed to be too heavy for a few individuals to remove easily. Moving and positioning of the well vault must be done with heavy equipment such as a backhoe or excavator, thereby making surreptitious removal difficult. Currently, a typical 6" diameter artesian drilled well is covered by a metal cap weighing approximately 10 pounds which is secured with 6 to 10 bolts. A terrorist or vandal can easily and surreptitiously remove this type of protective cap in order to facilitate contamination of the water supply and easily replace the well cap with very little difficulty. When the attached supply pump is actuated, it will pump contaminated water into the institution or home that has been targeted.

Although the above embodiment is designed to protect a 6" inch diameter well, it is envision that similar well cover can be made of dimensions appropriate to well sizes typically servicing schools, businesses, municipalities and individual home owners who are concerned about potential contamination, tampering or vandalism of their source of drinking water.

In another embodiment of the well vault cover, includes a screen mesh laid over the well opening extending beyond the circumference of the well opening such that when the well cover is positioned over the well opening, such that the screen mesh is secured in place and a seal is created between the screen mesh and the well cover thereby preventing rodents from burrowing under the well cover and gaining access to the wellhead.

In another embodiment of the well vault cover, includes placing a liquid-tight seal on the bottom surface of the well vault so that the well vault resists penetration by flood water. A special liquid-blocking vent system can be employed to prevent flood water from entering the vault through the vents.

In another embodiment the well cover includes one or more air vent pipes that penetrate the well cover wall and are oriented such that the entrance to the air vent pipe located at the surface of the well cover is lower relative to the exit of the air vent pipe into the inner cavity. This orientation prevents liquid contaminants from being poured directly into the well cover inner cavity. The air vents guarantee sufficient airflow into the inner cavity which is required for the proper functioning of the well pump since access to air is necessary to replace the water space cavity whenever the well pump is activated.

The envisioned air vents also may include a stainless steel screen or alternatively a stainless steel porous scrubber located in the air vent pipe having securing bolts running through the screen (or scrubber) and fastened to the air vent pipe wall which act to hold the screen (or scrubber) in place. This screen prevents rodents from infiltrating the inner cavity as well as preventing larger particulate contamination from entering the cavity whether from natural sources or from malicious tampering.

The envisioned air vents may also include a vented cap securing the outside entrance of the air vent. This provides a barrier to rodent infiltration and malicious tampering of the well through the air vents themselves.

The envisioned air vents may also include one or more jogs in the air vent pipe which increases the difficulty of a malicious individual accessing the wellhead chamber with the intent to tamper with it in some manner.

The dimensions depend on enveloping the wellhead, and achieving sufficient weight to make the vault difficult to move without heavy equipment. In one specific embodiment the vault is a conical bell shaped with rounded top, height 3', 34" base outer diameter, tapering up to 27" outer diameter, with rounded top above that. Wall thickness is about 7" at the base, tapering up to 3½", thereby forming inner chamber centered in vault with height 18" and diameter of 18". The dimensions of the inner chamber is 18" width-diameter. The height of the chamber is 18". The construction material is re-formed concrete. The steel rod options are reinforcement bar (re-bar), or other kinds of steel bars available. The depth of steel rod in vault wall is sufficient to support the weight of the vault.

Referring to the included drawings, FIG. 1 is a front elevation view of an embodiment of a wellhead vault of the present invention. The anti-alteration wellhead vault system, designated generally by the 10, includes precast concrete bell-shaped vault 11. The vault 11 has lifting elements 12 mounted on the top of the vault 11. The lifting element 12 is in the form of loops of metal bars the ends of which are embedded in the concrete of the vault 11. The lifting elements 12 allow the vault 11 to be placed and lifted using heavy construction equipment. The vault 11 also includes air vents 13 and 14.

The vault is sitting on a layer of sealing material 15, that is positioned between the bottom 16 of the vault 11 and a flat concrete pad 17. The pad 17 is buried in the ground 18.

Figure 2:
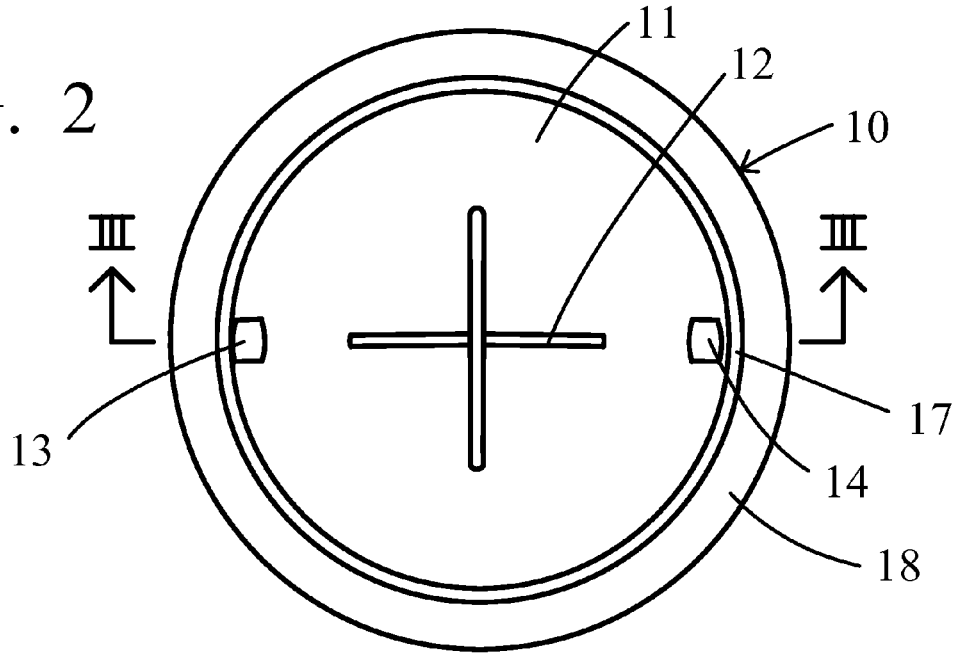
FIG. 2 is a plan view of the wellhead vault shown in FIG. 1.

FIG. 2 is a plan view of the wellhead vault shown in FIG. 1. The vault system 10 includes the vault 11. The vault 11 includes the lifting element 12, and the air vents 13 and 14. The vault 11 is sitting on the concrete pad 17 which is positioned in the ground 18.

Figure 3:
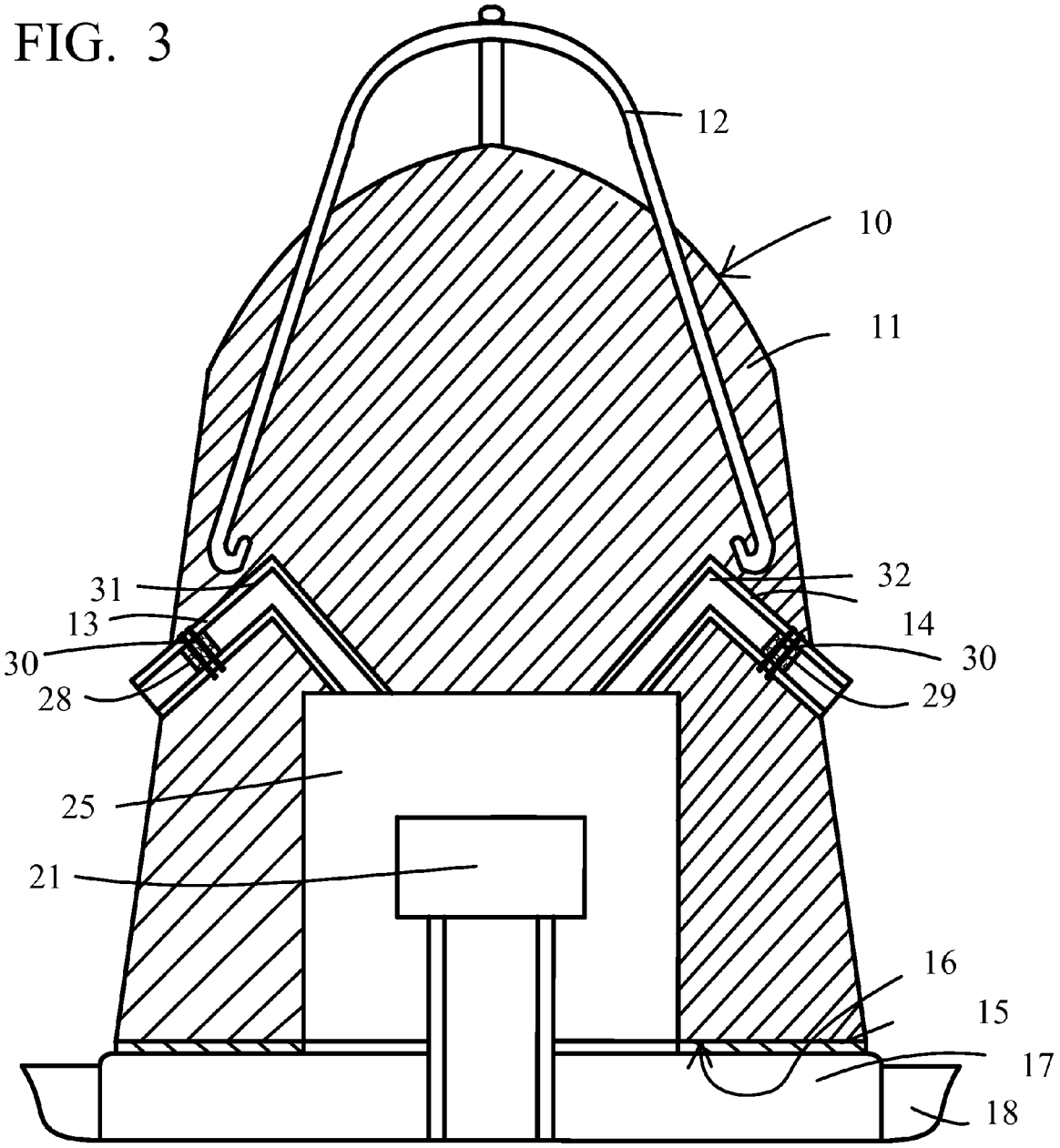
FIG. 3 is a sectional front elevation view of the wellhead vault shown in FIG. 1, as seen along the view line III-III of FIG. 2.

FIG. 3 is a sectional front elevation view of the wellhead vault shown in FIG. 1, as seen along the view line III-III of FIG. 2. The anti-alteration wellhead vault system, designated generally by the 10, includes precast concrete bell-shaped vault 11. The vault 11 has lifting elements 12 mounted on the top of the vault 11. The lifting element 12 is in the form of loops of metal bars the ends of which are embedded in the concrete of the vault 11. Preferably, the ends of the metal bars will be bent around to form hooks that will prevent the bars from being pulled out of the concrete. The lifting elements 12 allow the vault 11 to be placed and lifted using heavy construction equipment. The vault 11 also includes air vents 13 and 14.

The bottom 16 of the vault 11 is sitting on a layer of sealing material 15, that is positioned between the bottom 16 of the vault 11 and a flat concrete pad 17. The pad 17 is buried in the ground 18.

The wellhead 21 emerges from the ground 18 through the flat concrete pad 17, and stands substantially above the top of the concrete pad 17.

The vault 11 is shaped to form a hollow downwardly-opening wellhead chamber 25. The vault 11 is positioned so that the wellhead 21 is within the wellhead chamber, where it is protected from alteration by the vault 11.

The vault 11 includes air vent pipes 13 and 14 that penetrate the vault 11 wall, from the outer surface of the vault 11 to the wellhead chamber 25. The vents 13 and 14 are oriented such that the entrance to the air vent pipe located at the outer surface of the vault 11 is lower relative to the exit of the air vent pipe into the wellhead chamber 25. This orientation prevents liquid contaminants from being poured directly into the well cover inner cavity. The air vents guarantee sufficient airflow into the wellhead chamber 25 which is required for the proper functioning of the well pump since access to air is necessary to replace the water space cavity whenever the well pump is activated.

Each of the vents 13 and 14 also may include an air-porous solids trap 28 and 29, such as a stainless steel screen or alternatively a stainless steel porous scrubber located in the air vent pipe having securing bolts 30 running through the screen (or scrubber) and fastened to the air vent pipe wall which act to hold the screen (or scrubber) in place. This screen prevents rodents from infiltrating the inner cavity as well as preventing larger particulate contamination from entering the cavity whether from natural sources or from malicious tampering.

The air vents 13 and 14 may also include one or more jogs 31 and 32 in the air vent pipe, so that there is no straight-through path through the vent, which increases the difficulty of a malicious individual accessing the wellhead chamber with the intent to tamper with it in some manner.

Figure 4:
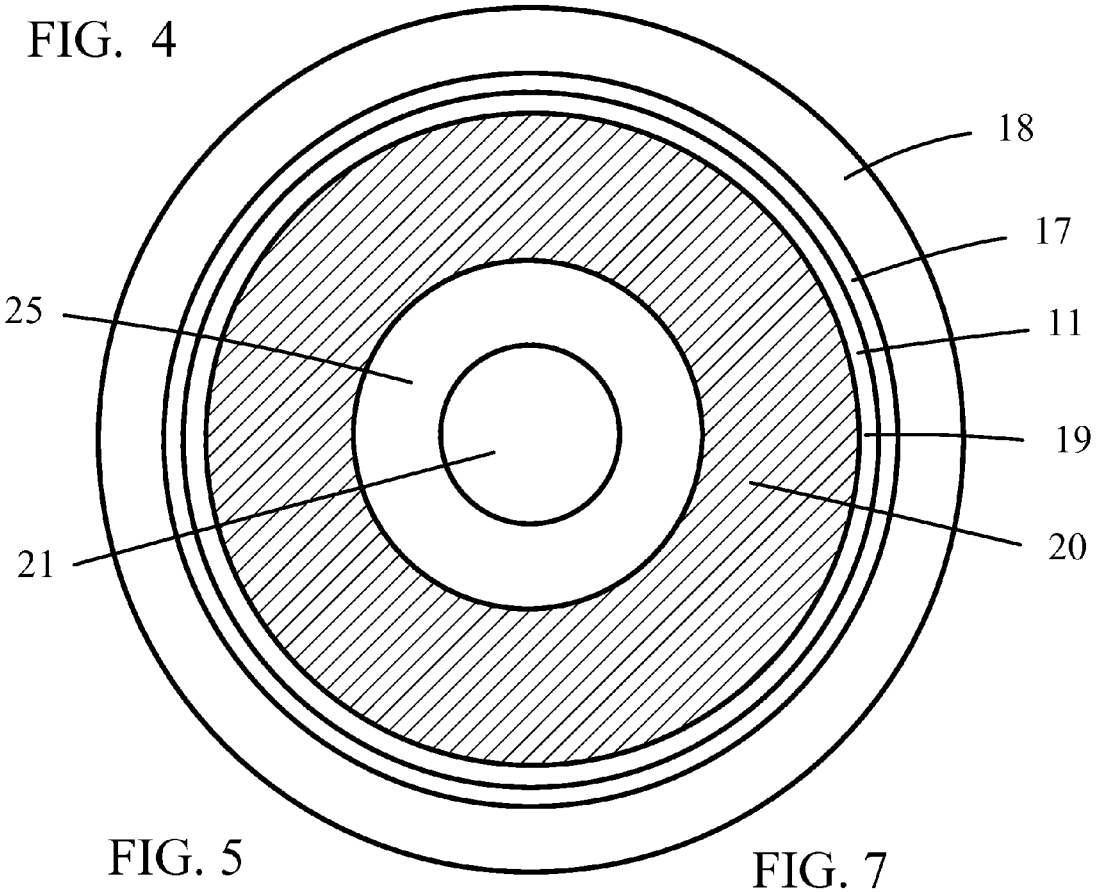
FIG. 4 is a sectional plan view of the wellhead vault shown in FIG. 1, as seen along view line IV-IV of FIG. 1.

FIG. 4 is a sectional plan view of the wellhead vault shown in FIG. 1, as seen along view line IV-IV of FIG. 1. The outer ring is the ground 18, and, moving inward, are the concrete pad 17, the outer wall 19 of the vault 11, the sectioned inner body 20 of the vault 11, the wellhead chamber 25, and the top of the wellhead 21 itself.

Figure 5:
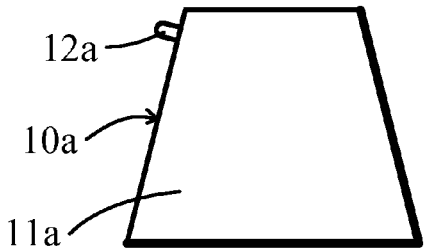
FIG. 5 is a front elevation view of a second embodiment of the present invention, having a square foot print.

FIG. 5 is a front elevation view of a second embodiment of the present invention, having a square foot print. This anti-alteration wellhead vault system, designated generally by the 10*a*, includes precast concrete bell-shaped vault 11*a*. The vault 11*a* has lifting elements 12*a* mounted on the side of the vault 11*a*. The lifting element 12*a* is in the form of a loop of a metal bar the ends of which are embedded in the concrete of the vault 11*a*. The lifting element 12*a* allows the vault 11*a* to be placed and lifted using heavy construction equipment. The vault 11*a* also includes air vents 13*a* and 14*a* (shown below).

Figure 6:
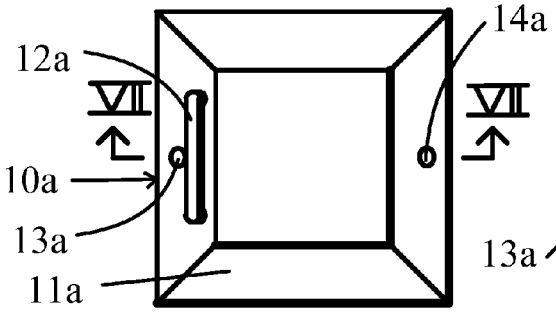
FIG. 6 is a plan view of the embodiment shown in FIG. 5.

FIG. 6 is a plan view of the embodiment shown in FIG. 5. The vault system 10*a* includes the vault 11*a*. The vault 11*a* includes the lifting element 12*a*, and the air vents 13*a* and 14*a*. The vault 11*a* might be sitting on a concrete pad which is positioned in the ground, around a wellhead.

Figure 7:
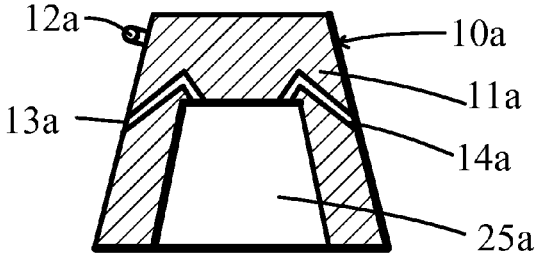
FIG. 7 is a sectional front elevation view of the embodiment shown in FIG. 5, as seen along the view line VII-VII of FIG. 6.

FIG. 7 is a sectional front elevation view of the embodiment shown in FIG. 5, as seen along the view line VII-VII of FIG. 6. The anti-alteration wellhead vault system, designated generally by the 10*a*, includes precast concrete bell-shaped vault 11*a*. The vault 11*a* has lifting elements 12*a* mounted on the side of the vault 11*a*. The lifting element 12*a* is in the form of a loop of metal bar, the ends of which are embedded in the concrete of the vault 11*a*. Preferably, the ends of the metal bar will be bent around to form hooks that will prevent the bars from being pulled out of the concrete. The lifting element 12*a* allows the vault 11*a* to be placed and lifted using heavy construction equipment. The vault 11*a* also includes air vents 13*a* and 14*a*.

Figure 8:
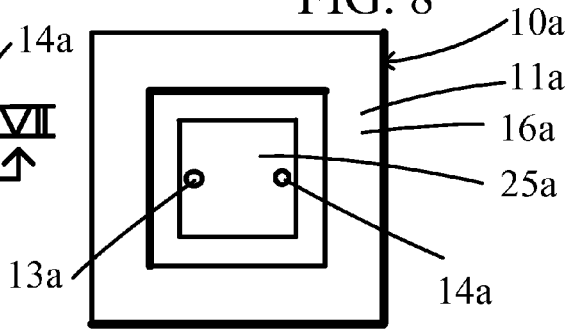
FIG. 8 is a bottom view of the embodiment shown in FIG. 5.

FIG. 8 is a bottom view of the embodiment shown in FIG. 5. The bottom view of the wellhead vault system 10*a*, shows the bottom 16*a* of the vault 11*a*, the wellhead chamber 25*a*, and the vents 13*a* and 14*a*.

Figure 9:
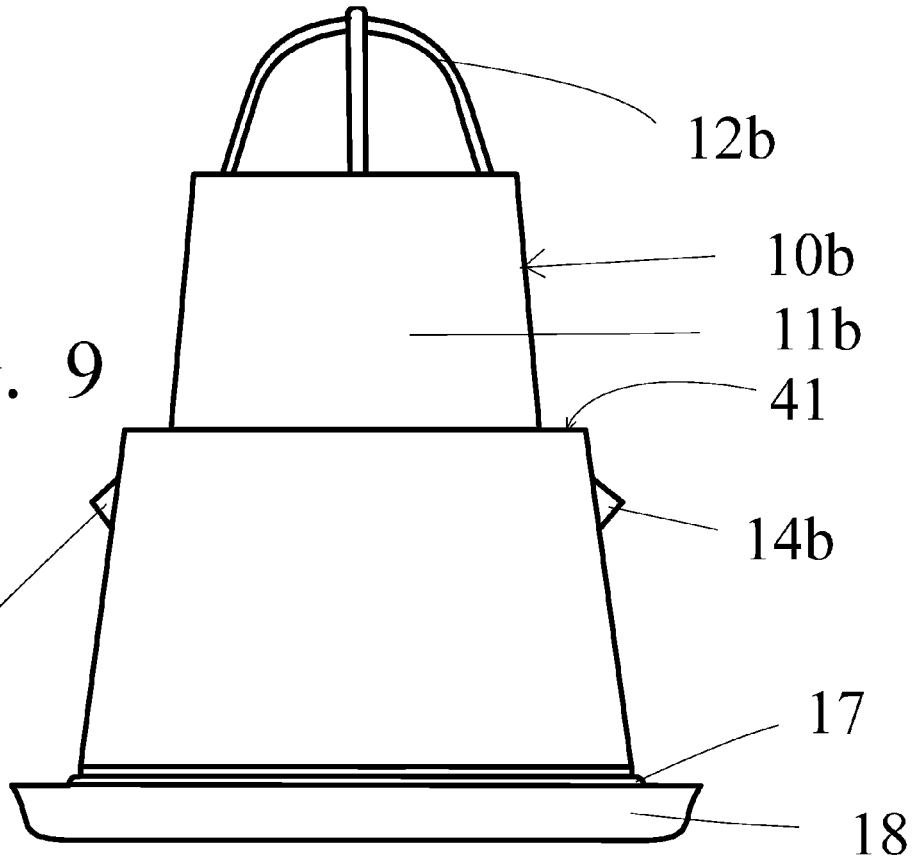
FIG. 9 is a third embodiment of the present invention in which a ledge is provided around the outside of the well vault.

FIG. 9 is a third embodiment of the well vault 11*b* present invention in which a step-like ledge 41 is provided around the outside of the well vault 11*b*. This ledge provides convenient support for a person to maintain the upper portion of the vault 11*b*, or to assist in connecting the lifting elements 12*b* to the heavy lifting equipment for positioning the vault 11*b*. This anti-alteration wellhead vault system, designated generally by the 10*b*, includes precast concrete bell-shaped vault 11*b*. The vault 11*b* has lifting elements 12*b* mounted on the top of the vault 11*b*. The lifting element 12*b* is in the form of loops of a metal bars the ends of which are embedded in the concrete of the vault 11*b*. The lifting element 12*b* allows the vault 11*b* to be placed and lifted using heavy construction equipment. The vault 11*b* also includes air vents 13*b* and 14*b*. The vault 11*b* be is sitting on a flat concrete pad 17 that is buried in the ground 18.

Figure 10:
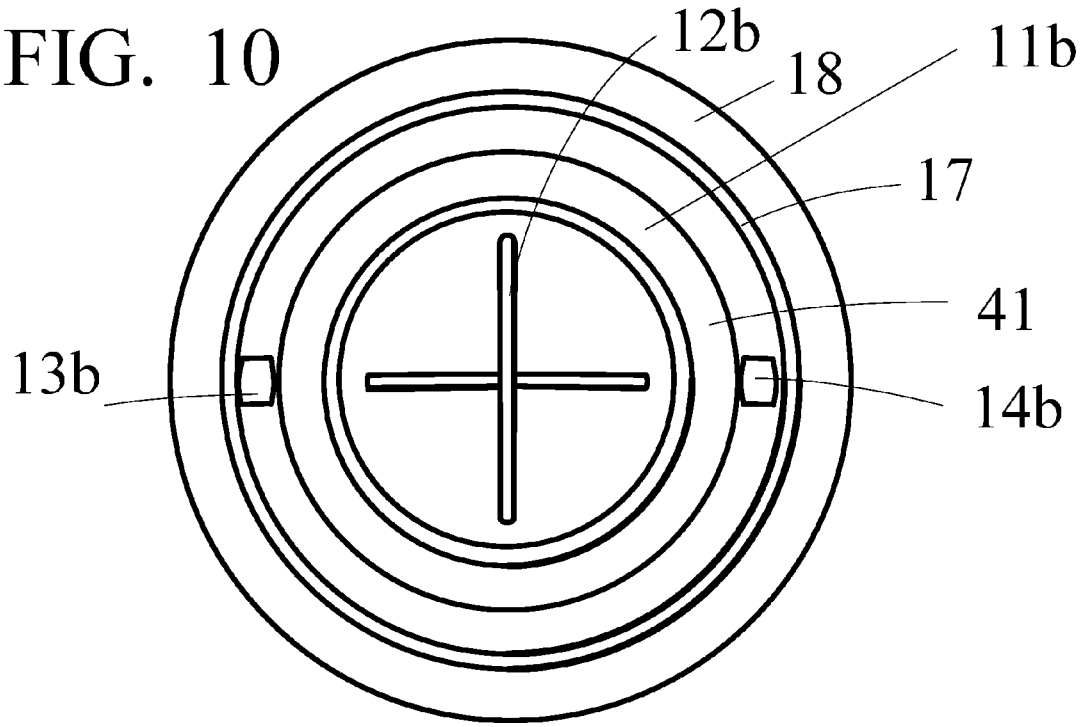
FIG. 10 is a plan view of the embodiment shown in FIG. 9.

FIG. 10 is a plan view of the embodiment shown in FIG. 9. This third embodiment of the well vault 11*b* presents invention in which a step-like ledge 41 is provided around the outside of the well vault 11*b*. This anti-alteration wellhead vault system, designated generally by the 10*b*, includes precast concrete bell-shaped vault 11*b*. The vault 11*b* has lifting elements 12*b* mounted on the top of the vault 11*b*. The lifting element 12*b* is in the form of loops of a metal bars the ends of which are embedded in the concrete of the vault 11*b*. The lifting element 12*b* allows the vault 11*b* to be placed and lifted using heavy construction equipment. The vault 11*b* also includes air vents 13*b* and 14*b*. The vault 11*b* be is sitting on a flat concrete pad 17 that is buried in the ground 18. The top of the vault as shown to be flat, but it could also be convex to allow water to drain, of concave to act as a bird bath.

Figure 11:
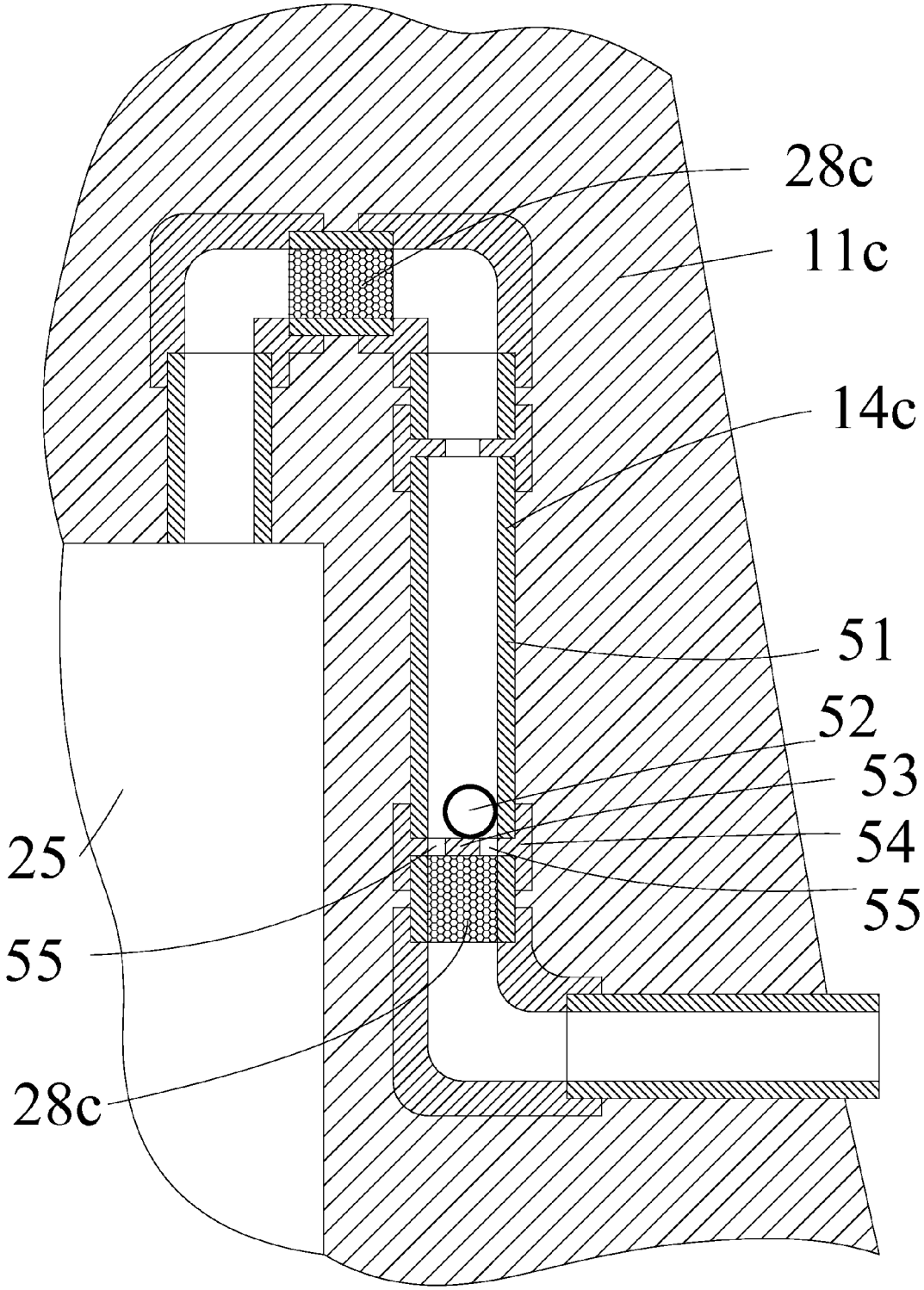
FIG. 11 is a sectional view of an alternative air vent for use in a wellhead vault embodying the principles of the present invention. This air vent is provided with a check valve that prevents flood water from entering the wellhead vault.

FIG. 11 is a sectional view of an alternative air vent 14*c* for use in a wellhead vault 11*c* embodying the principles of the present invention. This air vent is provided with a check valve 51 that prevents flood water from entering the wellhead vault 11. FIG. 11 shows the flotation ball 52 in its lower position in which air is allowed to pass in and out of the vent. The float ball 52 is sitting on a lower plate 53 that is part of a special coupling 54. The lower plate 53 extends across the bore of the vent 14*c*, and, because it has off-center bores 55, the presence of the float ball 52 on the lower plate 53, does not interfere with the flow of air through the lower plate 53. The vent 14*c* has two solids traps 28*c* to keep solid material out of the wellhead chamber 25.

Figure 12:
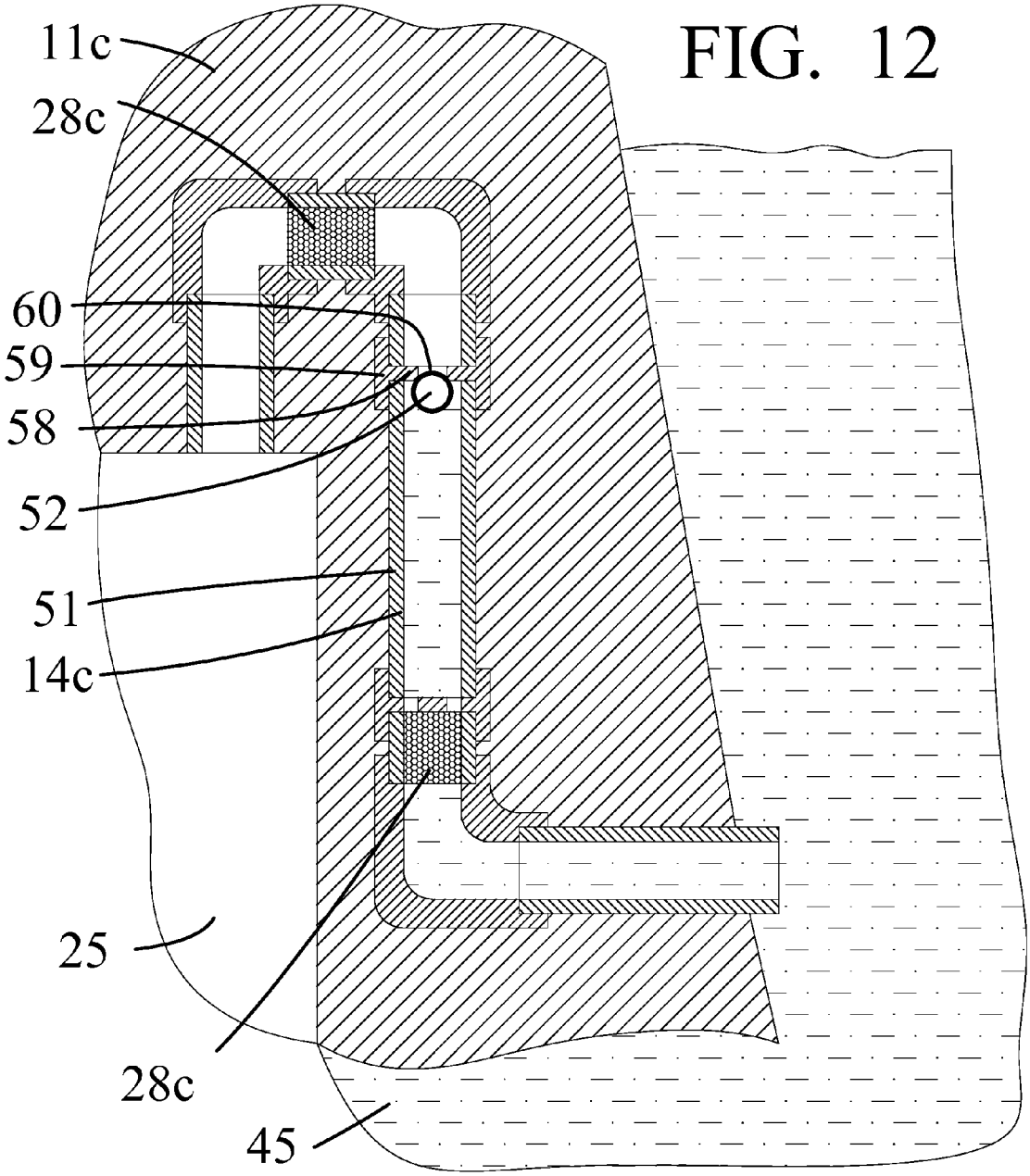
FIG. 12 is a sectional view of an alternative air vent for use in a wellhead vault embodying the principles of the present invention. This air vent is provided with a check valve that prevents water from entering the wellhead vault.

FIG. 12 is another sectional view of the alternative air vent 14*c* shown in FIG. 11, for use in a wellhead vault 11*c* embodying the principles of the present invention. In this case, flood water 45 has surrounded the vault 11*c* to the point where the wellhead chamber 25 is below water level. It would be desirable to prevent the flood water from entering the wellhead chamber 25 through the vent 14*c*. This air vent 14*c* is provided with a check valve 51 that prevents water from entering the wellhead vault 11*c*. FIG. 12 shows the flotation ball 52, pressed upward by water infiltration, into its upper position. The float ball 52 is pressed against an upper plate 58 that is part of a special coupling 59. The upper plate 58 extends across the bore of the vent 14*a*, and, because it has a center bore 60, the presence of the float ball 52 pressing against the upper plate 58, and blocking the center bore 60, stops the flow of water upward through the center bore 60 of the upper plate 58, and prevents water from passing into the wellhead chamber 25.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

1. An anti-alteration well connection comprising:

a) a water supply wellhead protruding from dry ground, and b) a wellhead vault enclosing the wellhead, i) the wellhead vault comprised of a wall of the wellhead vault, surrounding the wellhead, and closed at the top and open at the bottom defining an inner chamber of the wellhead vault, ii) the wellhead vault being made in a manner so as to be difficult for a few individuals to gain access to the wellhead by penetrating the wall of the wellhead vault or by moving the wellhead vault, iii) the wellhead vault positioned to securely enclose the wellhead within the inner chamber of the wellhead vault, thereby prohibiting alteration of the wellhead, iv) including a bore, having an outer opening to the outside of the wellhead vault and an inner opening to the inner chamber of the wellhead vault, the outer opening being at the outer surface of the wall of the wellhead vault and the inner opening being at the inner surface of the wall of the wellhead vault, providing air flow to the inner chamber of the wellhead vault, the bore specifically oriented upward towards the inner chamber of the wellhead vault, thereby preventing liquid from being poured therein, and v) the bore including a check valve with a floating ball, the check valve being situated in the bore such that air is allowed to pass freely through the bore into the inner chamber of the wellhead vault except when rising flood water infiltrates the bore, causing the float ball to rise, closing the check valve, and thereby preventing the flood water from entering the inner chamber of the wellhead vault.

2. An anti-alteration well connection comprising:

a) a water supply wellhead protruding from dry ground, and b) a wellhead vault enclosing the wellhead, i) the wellhead vault comprised of a wall of the wellhead vault, surrounding the wellhead, and closed at the top and open at the bottom defining an inner chamber of the wellhead vault, ii) the wellhead vault being made in a manner so as to be difficult for a few individuals to gain access to the wellhead by penetrating the wall of the wellhead vault or by moving the wellhead vault, iii) the wellhead vault positioned to securely enclose the wellhead within the inner chamber of the wellhead vault, thereby prohibiting alteration of the wellhead, and iv) the wellhead vault constructed of pre-formed concrete, including two steel rods, each rod having a first and second end portion, the end portions securely embedded opposite each other in the wall of the wellhead vault, each rod having a bight portion midway between the end portions protruding from the top of the wellhead vault, forming two overlapping diametrically opposed lifting points, centered over the wellhead vault, for attaching heavy duty lifting equipment for moving and positioning the wellhead vault.

3. An anti-alteration well connection comprising:

a) a water supply wellhead protruding from dry ground, and b) a wellhead vault enclosing the wellhead, i) the wellhead vault comprised of a wall of the wellhead vault, surrounding the wellhead, and closed at the top and open at the bottom defining an inner chamber of the wellhead vault, ii) the wellhead vault being made in a manner so as to be difficult for a few individuals to gain access to the wellhead by penetrating the wall of the wellhead vault or by moving the wellhead vault, iii) the wellhead vault positioned to securely enclose the wellhead within the inner chamber of the wellhead vault, thereby prohibiting alteration of the wellhead, iv) the wellhead vault further comprising a bore beginning at the outer surface of the wall of the wellhead vault and opening to the inner chamber of the wellhead vault, providing air flow to the wellhead, and (iv) including a metal screen situated in the bore, filling the entire cross-section of the bore, and held in place by a plurality of rods which are secured to the bore wall, thereby preventing foreign particulate material from entering the inner chamber of the wellhead vault.

4. An anti-alteration well connection comprising:

a) a water supply wellhead protruding from dry ground, and b) a wellhead vault enclosing the wellhead, i) the wellhead vault comprised of a wall of the wellhead vault, surrounding the wellhead, and closed at the top and open at the bottom defining an inner chamber of the wellhead vault, ii) the wellhead vault being made in a manner so as to be difficult for a few individuals to gain access to the wellhead by penetrating the wall of the wellhead vault or by moving the wellhead vault, iii) the wellhead vault positioned to securely enclose the wellhead within the inner chamber of the wellhead vault, thereby prohibiting alteration of the wellhead, and iv) the wellhead vault further comprising a rodent-resistant screen mesh laid at ground level, sealed around the wellhead, extending to the outer circumference of the wall of the wellhead vault, and held in place by the wellhead vault, forming a barrier to infiltration of the inner chamber of the wellhead vault by rodents.

5. An anti-alteration well connection comprising:

a) a water supply wellhead protruding from dry ground, and b) a wellhead vault enclosing the wellhead, i) the wellhead vault comprised of a wall of the wellhead vault, surrounding the wellhead, and closed at the top and open at the bottom defining an inner chamber of the wellhead vault, ii) the wellhead vault being made in a manner so as to be difficult for a few individuals to gain access to the wellhead by penetrating the wall of the wellhead vault or by moving the wellhead vault, iii) the wellhead vault positioned to securely enclose the wellhead within the inner chamber of the wellhead vault, thereby prohibiting alteration of the wellhead, iv) wherein the wellhead vault further comprises a bore beginning at the outer surface of the wall of the wellhead vault and opening to the inner chamber of the wellhead vault, providing air flow to the wellhead, including a vented cap covering the outside opening of the bore, and at least one check valve that prevents flood water from entering the inner chamber of the wellhead vault, and v) wherein the wellhead vault sits on a water impermeable pad and is connected to the water impermeable pad by a water impermeable sealant.

6. An anti-alteration well connection comprising:

a. a water supply wellhead protruding from dry ground and b. a bell shaped wellhead vault enclosing the wellhead, i) the wellhead vault constructed of pre-formed concrete, which pre-formed concrete comprises a surrounding wall of the wellhead vault defining an inner chamber of the wellhead vault, the inner chamber of the wellhead vault closed and rounded at the top and open at the bottom, the wellhead vault positioned to securely enclose the wellhead within the inner chamber of the wellhead vault, and the wellhead vault constructed in a manner to be difficult for a few individuals to gain access to the wellhead by penetrating the wall of the wellhead vault or by moving the wellhead vault, ii) including two steel rods, each rod having a first and second end portion, the end portions securely embedded opposite each other in the wall of the wellhead vault, each rod having a bight portion midway between the end portions protruding from the top of the wellhead vault, forming two overlapping diametrically opposed lifting points, centered over the wellhead vault, and said lifting points suitable for attaching heavy duty lifting equipment to the wellhead vault for the purpose of moving or positioning the wellhead vault, iii) including a bore, having an outer opening to the outside of the wellhead vault and an inner opening to the inner chamber of the wellhead vault, the outer opening being at the outer surface of the wall of the wellhead vault and the inner opening being at the inner surface of the wall of the wellhead vault, providing air flow to the inner chamber of the wellhead vault, the bore specifically oriented upward towards the inner chamber of the wellhead vault, thereby preventing liquid from being poured therein, (iv) including a metal screen situated in the bore, said metal screen filling the entire cross-section of the bore, and said metal screen held in place by a plurality of rods which are secured to the bore, thereby preventing foreign particulate material from entering the inner chamber of the wellhead vault, (iiv) including a vented cap covering the outside opening of the bore, and (iiiv) including a rodent-resistant screen mesh laid at ground level, sealed around the wellhead, extending to the outer circumference of the wall of the wellhead vault, and held in place by the wellhead vault, forming a barrier to infiltration of the inner chamber of the wellhead vault by rodents.

* * * * *